US010154327B2

(12) United States Patent
Auclair et al.

(10) Patent No.: US 10,154,327 B2
(45) Date of Patent: Dec. 11, 2018

(54) MOLDED ACOUSTIC MESH FOR ELECTRONIC DEVICES

(71) Applicant: APPLE INC., Cupertino, CA (US)

(72) Inventors: Martin J. Auclair, Cupertino, CA (US); Jared M. Kole, San Francisco, CA (US); Marwan Rammah, San Francisco, CA (US); David A. Pakula, Palo Alto, CA (US); Scott P. Porter, San Jose, CA (US)

(73) Assignee: Apple Inc., Cupertino, CA (US)

( * ) Notice: Subject to any disclaimer, the term of this patent is extended or adjusted under 35 U.S.C. 154(b) by 11 days.

(21) Appl. No.: 14/821,568

(22) Filed: Aug. 7, 2015

(65) Prior Publication Data

US 2016/0073183 A1 Mar. 10, 2016

Related U.S. Application Data

(60) Provisional application No. 62/047,564, filed on Sep. 8, 2014.

(51) Int. Cl.

| | |
|---|---|
| ***H04R 1/02*** | (2006.01) |
| ***G10K 11/18*** | (2006.01) |
| *H04R 1/00* | (2006.01) |

(52) U.S. Cl.

CPC ..... *H04R 1/021* (2013.01); *G10K 11/18* (2013.01); *H04R 1/023* (2013.01); *H04R 2499/11* (2013.01)

(58) Field of Classification Search

USPC ..... 181/151, 152, 153, 199; 381/333, 336, 381/338, 345, 347

See application file for complete search history.

(56) References Cited

U.S. PATENT DOCUMENTS

| | | | | |
|---|---|---|---|---|
| 5,790,679 | A * | 8/1998 | Hawker | H04M 1/0202 379/388.02 |
| 6,002,949 | A * | 12/1999 | Hawker | H04M 1/0202 361/814 |
| 6,064,894 | A * | 5/2000 | Zurek | H04M 1/0214 455/347 |
| 6,512,834 | B1 * | 1/2003 | Banter | H04R 1/086 381/189 |
| 6,785,395 | B1 * | 8/2004 | Arneson | H04M 1/03 379/432 |
| 8,055,003 | B2 * | 11/2011 | Mittleman | H04M 1/035 381/345 |
| 8,442,254 | B2 * | 5/2013 | Yu | H04R 1/025 381/334 |

(Continued)

FOREIGN PATENT DOCUMENTS

JP 61004398 A * 1/1986

*Primary Examiner* — Edgardo San Martin

(74) *Attorney, Agent, or Firm* — Kilpatrick Townsend and Stockton, LLP

(57) ABSTRACT

An electronic device has a speaker housing secured within the device housing. The speaker housing has a cavity with a speaker at one end and a port at the other configured to communicate through an aperture in the housing of the electronic device. A panel of acoustic mesh is integrally formed within the cavity of the housing and is disposed between the port and the speaker. In other embodiments flexible structures are integrally molded onto a plate or the acoustic device and used to secure and acoustically seal the acoustic device within the device housing.

18 Claims, 5 Drawing Sheets

(56) References Cited

U.S. PATENT DOCUMENTS 8,488,817 B2 * 7/2013 Mittleman ..... H04M 1/035 381/189
8,675,903 B2 * 3/2014 Ng ..... H04M 1/035 181/149
8,724,841 B2 * 5/2014 Bright ..... H04R 1/086 181/284
8,804,990 B2 * 8/2014 Chang ..... H04M 1/035 381/345
8,804,993 B2 * 8/2014 Shukla ..... B29C 45/1671 381/189
8,830,662 B2 * 9/2014 Myers ..... H05K 5/0086 174/521
9,237,389 B2 * 1/2016 Yu ..... H04R 1/025
9,357,299 B2 * 5/2016 Kwong ..... H04R 3/007
9,363,589 B2 * 6/2016 Lippert ..... H04R 1/023
9,374,635 B2 * 6/2016 Kole ..... H04R 1/023
9,414,141 B2 * 8/2016 Cohen ..... H04M 1/03
9,538,272 B2 * 1/2017 Auclair ..... G10K 11/18
9,742,888 B1 * 8/2017 Hisano ..... H04M 1/035
2003/0165249 A1 * 9/2003 Higuchi ..... H04R 9/063 381/318
2005/0077102 A1 * 4/2005 Banter ..... H04R 1/086 181/149
2009/0103704 A1 * 4/2009 Kitada ..... H04M 1/0291 379/167.14
2009/0233651 A1 * 9/2009 Weckstrom ..... H04M 1/035 455/569.1
2009/0245565 A1 * 10/2009 Mittleman ..... H04M 1/035 381/365
2011/0255728 A1 * 10/2011 Abe ..... H04R 1/086 381/355
2012/0045081 A1 * 2/2012 Mittleman ..... H04M 1/035 381/334
2012/0177237 A1 * 7/2012 Shukla ..... B29C 45/1671 381/332
2013/0108082 A1 * 5/2013 Dave ..... H04R 1/086 381/122
2013/0170109 A1 * 7/2013 Cohen ..... H04M 1/03 361/679.01
2016/0073194 A1 * 3/2016 Auclair ..... G10K 11/18 381/345

* cited by examiner

Section A-A

MOLDED ACOUSTIC MESH FOR ELECTRONIC DEVICES

CROSS REFERENCES TO OTHER APPLICATIONS

This application claims priority to U.S. provisional patent application Ser. No. 62/047,564, for "MOLDED ACOUSTIC MESH FOR ELECTRONIC DEVICES" filed on Sep. 8, 2014 which is hereby incorporated by reference in entirety for all purposes.

FIELD

The described embodiments relate generally to electronic devices that employ acoustic elements, such as speakers and/or microphones, within a housing of an electronic device. More particularly, the present embodiments relate to panels of acoustic mesh disposed between the acoustic element and the external environment, while other embodiments relate to flexible structures that acoustically seal and retain acoustic elements within the electronic device.

BACKGROUND

Currently there are a wide variety of electronic devices that include acoustic elements (i.e., microphones and speakers) located within the housing of electronic devices. To protect the acoustic elements from damage and to optimize their performance, acoustically permeable materials may be employed between the acoustic elements and the environment outside of the electronic device. In addition, acoustic elements may perform better when they are acoustically sealed to the housing of the electronic device.

New electronic devices may require new features or new methods of implementing acoustically permeable materials and acoustic seals to facilitate their performance and aesthetics.

SUMMARY

Some embodiments of the present invention relate to acoustically permeable materials that are integrally molded into housings such as those used for a speaker. Some embodiments relate to flexible seals for acoustic elements where the seals are configured to minimize the amount of acoustic energy passed between the interior of the electronic device and the external environment.

In some embodiments a speaker housing comprises one or more walls forming a cavity having a first end in communication with a speaker and a second end disposed opposite the first end. The second end may have a port opening to an exterior environment. A panel of acoustic mesh may be disposed within the cavity between the first end and the port and having a portion integrally molded into at least one of the one or more walls. In various embodiments the speaker housing may further comprise a speaker coupled to the first end. In some embodiments the panel of acoustic mesh has a perimeter that is integrally formed with the one or more walls and may be configured to span across the entire cavity.

In some embodiments the panel of acoustic mesh is insert molded into the one or more walls that may be made from a plastic material. In various embodiments the speaker housing is integrally formed into a housing of an electronic device and a panel of cosmetic mesh may be disposed between the panel of acoustic mesh and the exterior environment. In some embodiments the second end of the speaker housing is configured to mate to a housing of an electronic device such that acoustic energy may pass from a speaker disposed at the first end of the cavity, through the panel of acoustic mesh and out the port disposed at the second end.

In some embodiments an electronic device comprises a housing having an aperture and a speaker housing mated to an inside surface of the housing. The speaker housing may have a cavity formed by one or more walls with the cavity having a first end and a second end. The second end opening to the aperture and the first end may have a speaker in communication with it. A panel of acoustic mesh may be disposed between the first end and the second end, spanning across the cavity and having a perimeter integrally formed with the one or more walls. In various embodiments a panel of cosmetic mesh is disposed between the panel of acoustic mesh and an external environment.

In some embodiments the panel of cosmetic mesh is secured between the speaker housing and the housing. In various embodiments the panel of cosmetic mesh is integrally formed into the housing of the electronic device. In some embodiments the panel of cosmetic mesh is formed from woven wires or from a woven fabric. In various embodiments the speaker housing is integrally formed as a portion of the electronic device housing.

In some embodiments a method of making a speaker housing comprises forming a panel of acoustic mesh and securing the panel of acoustic mesh in a molding tool. Plastic material is injected into the molding tool to form a plastic speaker housing such that the panel of acoustic mesh is integrally formed with one or more walls of the speaker housing. The one or more walls form a cavity having a first end configured to communicate with a speaker and a second end opening to an aperture of an electronic device.

In some embodiments the panel of acoustic mesh is formed by cutting it out of a sheet. In various embodiments the panel of acoustic mesh is secured in the molding tool by compressing at least a portion of its perimeter such that the plastic material is prevented from flowing into the cavity. In some embodiments the panel of acoustic mesh is configured to span across the entire cavity.

DETAILED DESCRIPTION

Some embodiments of the present invention relate to acoustically permeable materials and methods of employing such materials in electronic devices. Some embodiments relate to flexible seals for acoustic elements that are configured to minimize the amount of acoustic energy passed between the interior of the electronic device and the external environment. While the present invention can be useful for a wide variety of configurations, some embodiments of the invention are particularly useful for electronic devices that use internal acoustic meshes and/or elastomeric seals, as described in more detail below.

For example, in some embodiments an injection molded plastic speaker housing is mounted within an electronic device. The speaker housing has a cavity and secures an acoustic element, such as a speaker, at one end of the cavity and has a port at the other end of the cavity that communicates with the external environment. During the injection molding process used to form the speaker housing, a panel of acoustic mesh is integrally molded into the housing and located between the speaker and the port to the external environment. The panel of acoustic mesh is acoustically permeable so that sound may pass from the speaker to the environment, however the mesh protects the speaker from damage from the external environment and may also contribute to the acoustic performance of the speaker.

In another example one or more acoustic elements (e.g., speakers or microphones) may be mounted within an electronic device using a plate having an elastomeric boot molded onto it. The boot may have a flexible opening configured to receive the acoustic element and simultaneously retain the acoustic element while acoustically sealing it to the device housing. In a further example flexible ribs may be molded onto a portion of an acoustic element and used to secure and seal the acoustic element within an aperture of the housing of the electronic device.

In order to better appreciate the features and aspects of acoustic meshes and acoustically sealed boots for electronic devices according to the present invention, further context for the invention is provided in the following section by discussing one particular implementation of an electronic device according to embodiments of the present invention. These embodiments are for example only and other embodiments may be employed in other electronic devices such as, but not limited to computers, watches, media players and other devices.

Figure 1:
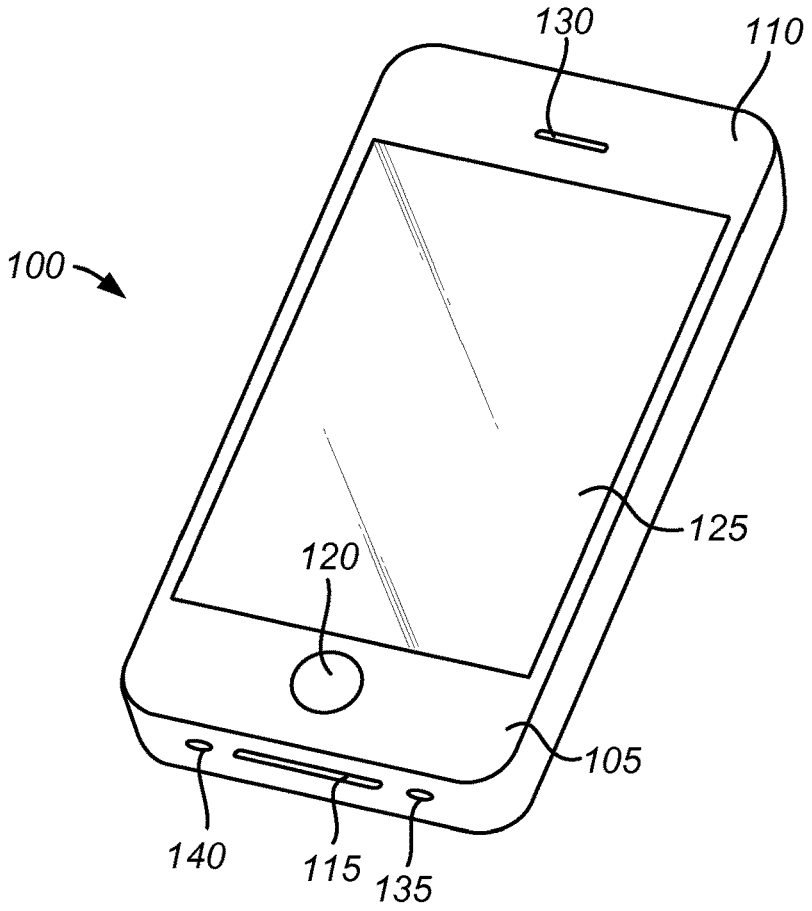
FIG. 1 is a front perspective view of an electronic device according to an embodiment of the invention.

FIG. 1 depicts an illustrative rendering of an electronic device 100 that includes a housing 105 with exterior surface 110 having a receptacle connector 115, a multipurpose button 120 as an input component and a touch screen display 125 as both an input and output component. Electronic device 100 also has one or more microphones and speakers as described in more detail below.

In some embodiments, electronic device 100 is a phone and has a receiver aperture 130 containing one or more acoustic elements (i.e., a speaker and/or a microphone). In various embodiments receiver aperture 130 contains both a speaker for a user to hear a caller as well as a microphone disposed in the same aperture that can be used for noise cancellation or other purposes. These features will be illustrated in greater detail below.

Electronic device 100 may also have additional acoustic elements disposed in other apertures within housing 105. In some embodiments electronic device 100 may have a transmitter aperture 135 containing a microphone to receive a user's voice. Various embodiments may have a loudspeaker aperture 140 containing a speaker for features such as a speakerphone. As discussed in more detail below, in some embodiments any or all of apertures 130, 135, 140 may employ a panel of acoustic mesh that may act as a barrier to water and debris while allowing acoustic energy to pass through. Although examples of apertures containing acoustic elements have been provided, other configurations are possible and within the scope of this disclosure.

Figure 2:
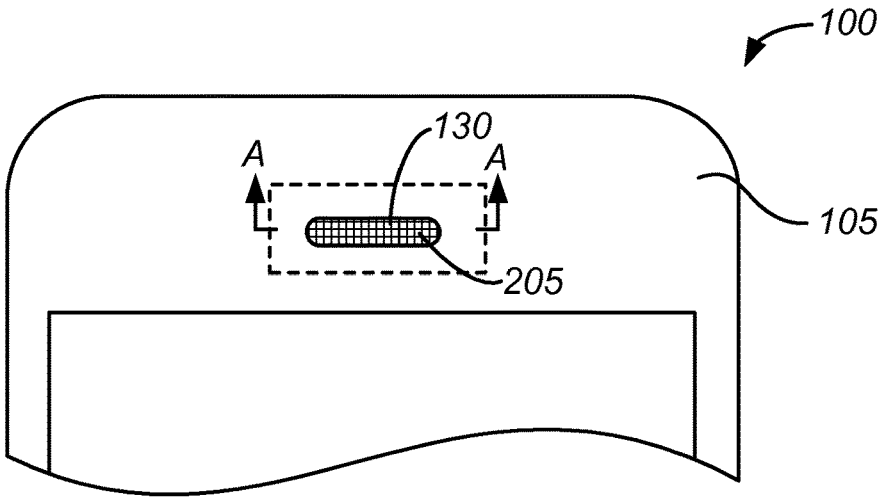
FIG. 2 is a close up view of a receiver aperture of the electronic device shown in FIG. 1.

Now referring to FIG. 2 a magnified view of receiver aperture 130 of electronic device 100 is illustrated. A cosmetic mesh 205 is disposed within aperture 130 and may act as a barrier to water and debris while allowing acoustic energy from a speaker and other components within housing 105 to pass through. An acoustic mesh may also be disposed within aperture 130, as discussed in more detail below. Section A-A through aperture 130, cosmetic mesh 205 and other components within housing 105 is illustrated in FIG. 3.

Figure 3:
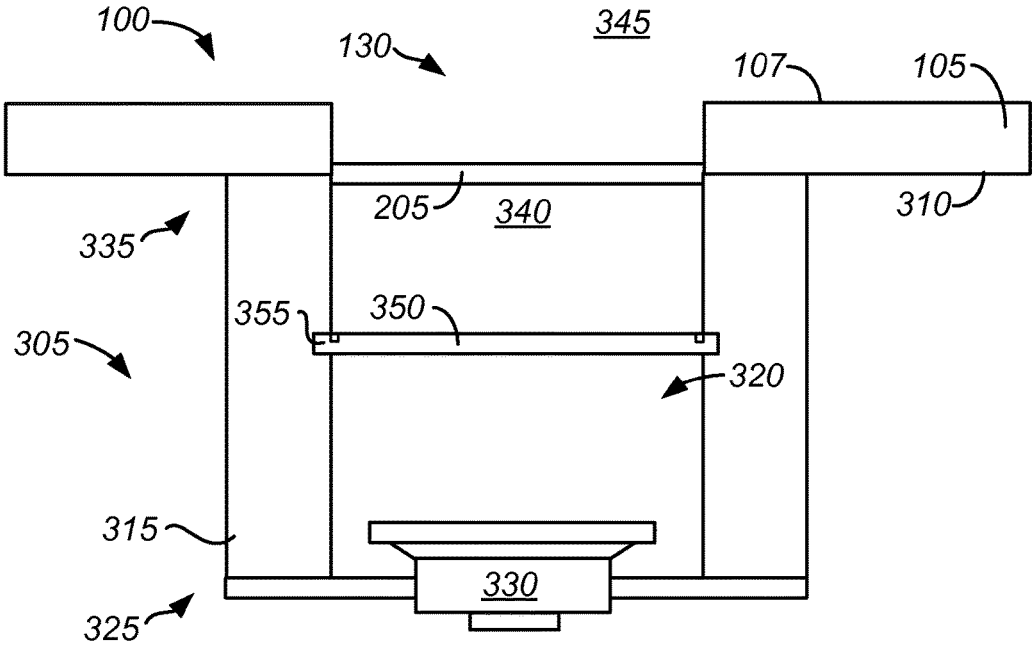
FIG. 3 is a partial cross-sectional view of the receiver aperture shown in FIG. 2.

FIG. 3 shows cross-section A-A through receiver aperture 130 and housing 105 of electronic device 100. In some embodiments, housing 105 has a speaker housing 305 secured to an interior surface 310. Speaker housing 305 may include one or more walls 315 that form a cavity 320. Cavity 320 may have a first end 325 configured to couple to a speaker 330 and a second end 335 disposed opposite the first end. In various embodiments second end 335 has a port 340 coupling cavity 320 to an exterior environment 345. In some embodiments a panel of acoustic mesh 350 is disposed within cavity 320 between first end 325 and port 340, as discussed in more detail below.

In various embodiments a portion of panel of acoustic mesh 350 is integrally molded into at least one of one or more walls 315, as described in more detail below. In some embodiments panel of acoustic mesh 350 has a perimeter 355 that is integrally formed into one or more walls 315. In various embodiments panel of acoustic mesh 350 may be integrally formed into one or more walls 315 using an insert molding process as discussed in more detail below. In some embodiments, panel of acoustic mesh 350 may be configured to span across the entire cavity 320. More specifically, panel of acoustic mesh 350 may span cavity 320 from one wall 315 to the other, such that all acoustic energy from speaker 330 must pass through the panel of acoustic mesh to exit port 340.

In some embodiments a panel of cosmetic mesh 205 may be disposed between panel of acoustic mesh 350 and exterior environment 345. In various embodiments panel of cosmetic mesh 205 is secured between speaker housing 305 and housing 105 using a compressible foam or elastomer along with a pressure sensitive adhesive (PSA) around a perimeter of the acoustic mesh to form an acoustic seal. In some embodiments panel of cosmetic mesh 205 may be integrally formed into speaker housing 305 or housing 105 of electronic device 100. In various embodiments speaker housing 305 may be integrally formed as a portion of housing 105, and panel of acoustic mesh 350 and/or cosmetic mesh 205 may be integrally molded into one or more walls 315.

In some embodiments panel of acoustic mesh 350 may be formed from a woven fabric, cloth or other material. In various embodiments panel of acoustic mesh 350 may be formed with a perforated film. Panel of acoustic mesh 350 may be any material configured to act as a barrier to water and debris while allowing sound to pass clearly, along with having other acoustic properties such as controlling the excursion and pressure responses of speaker 330. In some embodiments panel of acoustic mesh 350 may also be used to partially obscure speaker 305 from view from outside of housing 105, providing a more uniform appearance to outer surface 107 of electronic device 100. In various embodiments, panel of acoustic mesh 350 is made from polyethylene terephthalate (PET) and may be insert-molded into housing sidewalls 315, as described in more detail below. Myriad types of acoustic meshes are available and are within the scope of this disclosure.

In some embodiments panel of cosmetic mesh 205 may be formed from woven fabric, cloth, wires or other material such as a perforated film. In various embodiments panel of cosmetic mesh 205 may be used to partially obscure speaker 330 from view from outside of housing 105, providing a more uniform appearance to outer surface 107 of electronic device 100. Panel of cosmetic mesh 205 may be any material configured to act as a barrier to water and debris while allowing sound to pass clearly.

Figure 4A:
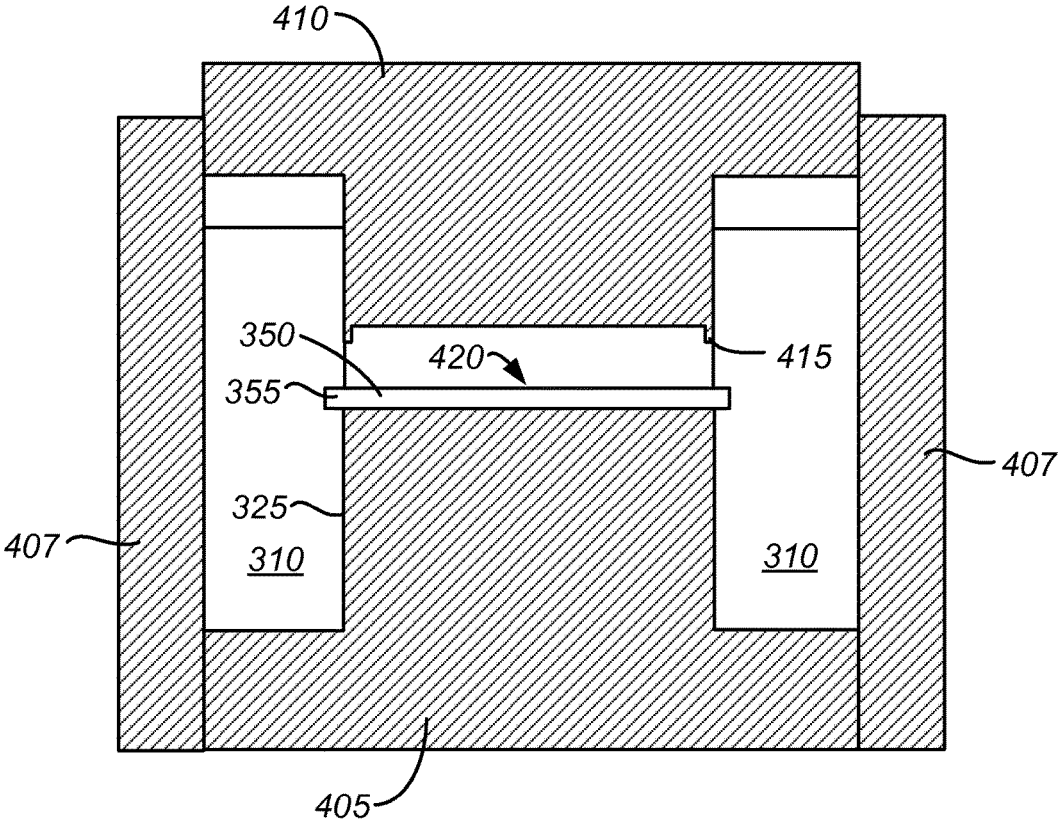
FIG. 4A is a partial cross-sectional view of an insert-molding system used to form the speaker housing shown in FIG. 3.

Now referring to FIG. 4A an acoustic mesh insert molding apparatus is illustrated. A first insert molding die 405 may have a precut panel of acoustic mesh 350 placed on it. In some embodiments pins or registration features may be used to locate panel of acoustic mesh 350 on first insert molding die 405. A second insert molding die 410 is moved towards first insert molding die 405 until a predetermined gap between the first and second die is achieved. Second insert-molding die 410 may have a step feature 415 that is disposed around perimeter 355 of acoustic mesh 350 as discussed in more detail below. Step feature 415 may act as a barrier to the flow of plastic resin during the molding process so that molten plastic does not flow into central area 420 of acoustic mesh 350. Side portions 407 of die may be separate components or may be a portion of first die 405.

Figure 4B:
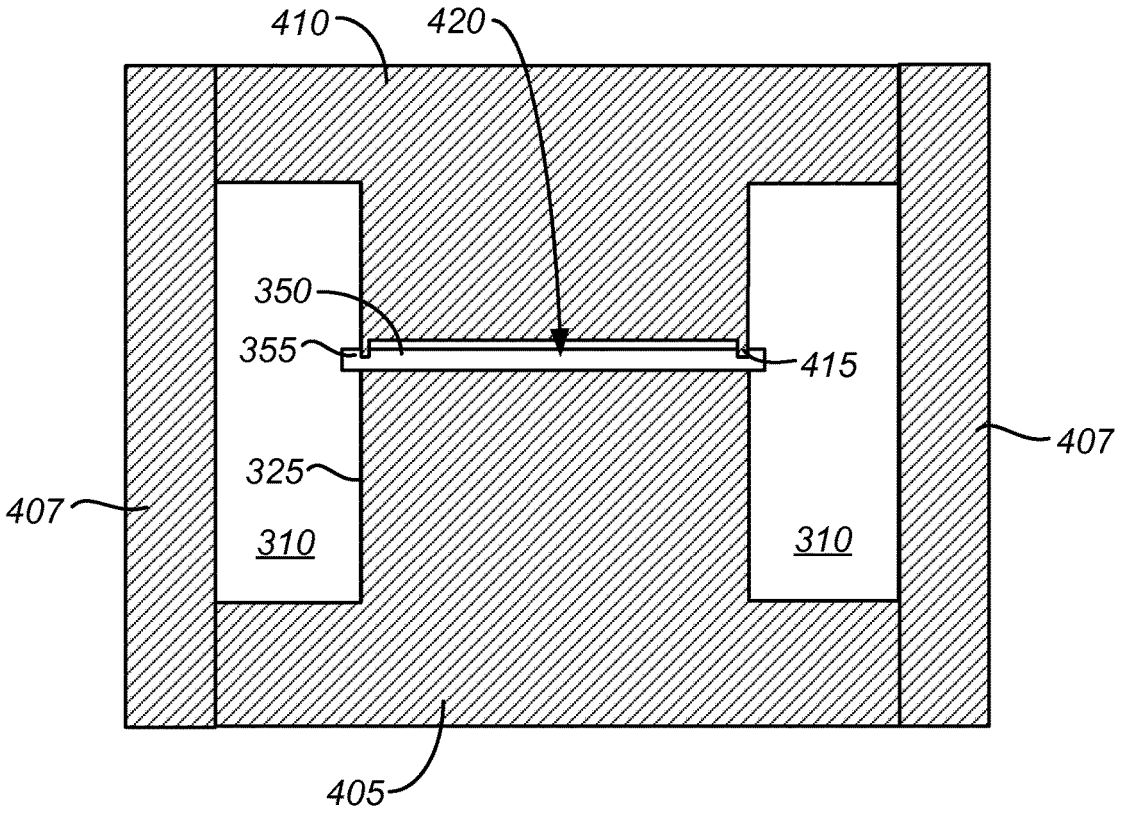
FIG. 4B is a partial cross-sectional view of an insert-molding system used to form the speaker housing shown in FIG. 3.

Now referring to FIG. 4B, second insert molding die 410 has been moved into its final position to prepare for the injection molding process. Step feature 415 has compressed acoustic mesh 350 an adequate amount so that a reliable seal is formed, blocking the flow of molten plastic towards central area 420. Molten plastic is then injected into the mold cavities, forming speaker housing 310 and integrally molding perimeter 355 of acoustic mesh 350 into the speaker housing. More specifically, molten plastic flows around, and in some embodiments, through perimeter 355 of acoustic mesh 350. Once the molten plastic solidifies, perimeter 355 of acoustic mesh 350 is an integral part of speaker housing 310.

After the molten plastic solidifies, first and second insert molding dies, 405, 410, respectively, are moved away from one another and speaker housing 310 is ejected. Speaker housing 310 then moves on to subsequent assembly steps where speaker 330 (see FIG. 3) and the other components are integrated, forming a completed assembly.

Figure 4C:
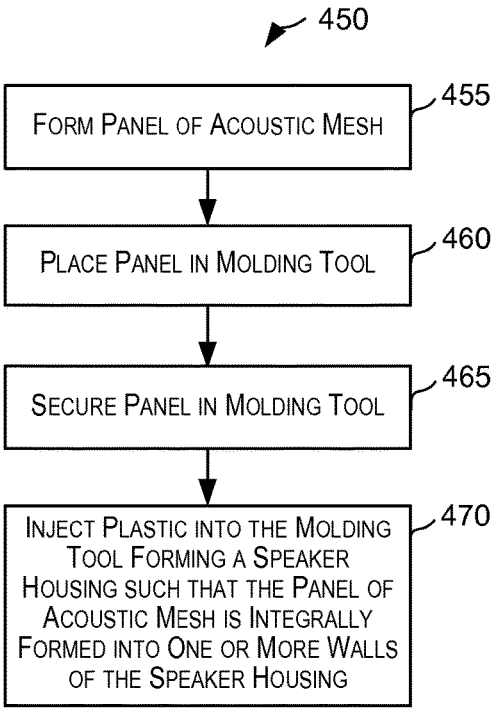
FIG. 4C is a flow chart illustrating a method of forming a speaker housing having an integrally formed panel of acoustic mesh as illustrated in FIG. 3.

Now referring to FIG. 4C, a method 450 for making a speaker housing with an integral acoustic mesh panel is illustrated. In step 455 a panel of acoustic mesh is formed. In some embodiments a panel of acoustic mesh is stamped or cut from a larger sheet into a smaller format that will fit into the electronic device. In step 460 the panel of acoustic mesh is placed in a molding too. In some embodiments the panel of acoustic mesh may be placed by an operator or by a robot. In various embodiments the panel of acoustic mesh may be placed on one or more pins that may hold it in the proper location. In step 465 the panel of acoustic mesh may be secured within the molding tool such that a perimeter of the panel may be molded into one or more of the walls of the speaker housing. In some embodiments the panel of acoustic mesh may be secured by a step feature or other feature within the mold tool that compresses and holds the panel in place. In some embodiments, the entire perimeter of the panel of acoustic mesh may be held in place by the mold tooling such that it doesn't move when subjected to the forces of the flowing molten plastic. In step 470 molten plastic is injected into the molding tool to form a speaker housing. The molten plastic is injected in such a way as to integrally form the panel of acoustic mesh into one or more walls of the speaker housing. After injecting the plastic and sufficient time is allowed for solidification, the housing may be ejected from the tooling.

Figure 5:
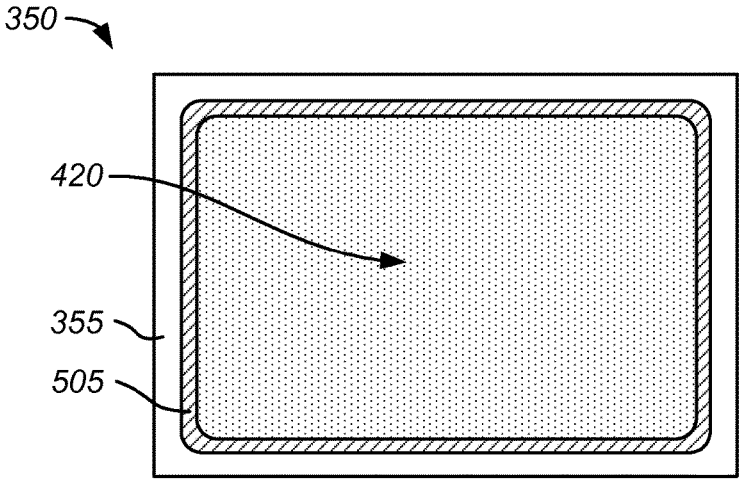
FIG. 5 is a plan view of the panel of acoustic mesh shown in FIG. 3 with the speaker housing removed.

Now referring to FIG. 5 an insert-molded acoustic mesh panel 350 is shown in plan view with speaker housing 310 (see FIG. 4) removed for clarity. Outer perimeter 355 of acoustic mesh panel 350 is integrally molded within speaker housing 315 (see FIG. 4). Ring 505 is a portion of acoustic mesh 350 that has been compressed by step 415 (see FIG. 4) on second insert molding tool 410. In some embodiments after the molding process, ring 505 may not regain its prior shape and may remain in a compressed state yielding a region of higher acoustic resistance that can be further tuned along with the base mesh properties to modify the acoustic response of the system. Central area 420 of acoustic mesh 350 retains its original acoustic properties.

In some embodiments acoustic mesh 350 may be a three-dimensional shape and be insert-molded into speaker housing 315 (see FIG. 4). For example, in various embodiments acoustic mesh 350 may be formed from woven wires and formed into a convex shape then insert molded into speaker housing 315. Acoustic mesh 350 may be formed into a three-dimensional shape using any process, including but not limited, to single-stage or progressive die forming.

Figure 6:
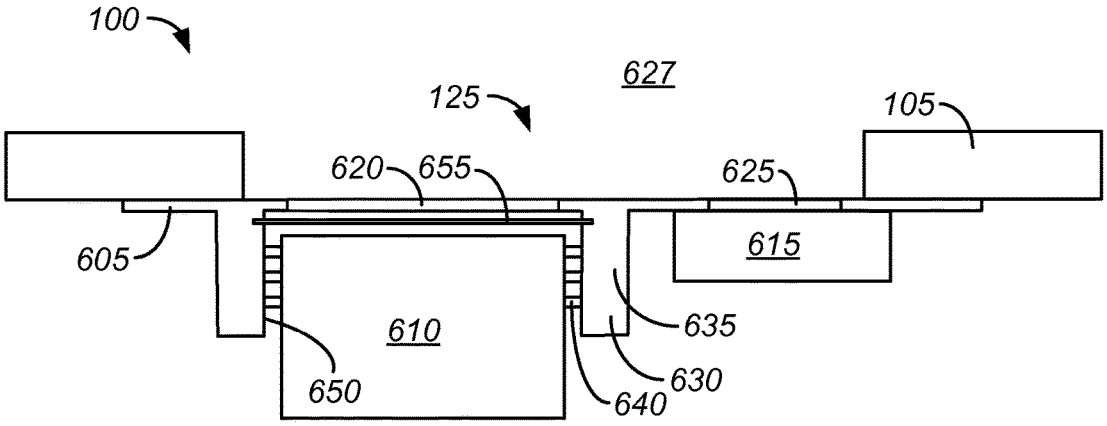
FIG. 6 is a partial cross-sectional view of the receiver aperture another embodiment of the electronic device illustrated in FIG. 1 where the receiver aperture contains two acoustic elements.

Now referring to FIG. 6 another example of electronic device 100 (see FIG. 1) is illustrated. FIG. 6 is also an illustration of cross-section A-A through aperture 125 illustrated in FIG. 2, however in this example aperture 125 has two acoustic elements disposed within it where both elements are secured to a unitary mounting plate 605.

Housing 105 of electronic device 100 has aperture 125, such that acoustic elements 610, 615 are in communication with external environment 627. In some embodiments acoustic element 610 is a speaker and acoustic element 615 is a microphone, although various embodiments may have different configurations. Speaker and microphone 610, 615, respectively, may be secured to unitary plate 605 as described in more detail below. Plate 605 may have one or more penetrations 620, 625 within it such that acoustic energy may pass between external environment 627 and speaker and microphone 610, 615, respectively. Plate 605 may have one or more elastomeric boots 630 disposed on it. Elastomeric boot 630 may be used to interface with acoustic element 610, forming an acoustic seal around the entire perimeter of the acoustic element and holding the acoustic element in place. In some embodiments elastomeric boot 630 has a continuous wall 635 with a plurality of sequential ridges 640 formed on an internal surface 650. Sequential ridges 640 may deflect and compress around acoustic element 610 to form an acoustic seal to the acoustic element.

In some embodiments, elastomeric boot 630 may be molded on plate 605 using a similar process as was described above with regard to insert-molding. Plate 605 may be compressed between two molding dies and liquid material may be injected into the mold cavities. The liquid material may be cured or hardened and the molds removed leaving boot 630 adhered to plate 605. In various embodiments plate 605 is made from steel and elastomeric boot 630 is made from an elastomer such as, but not limited to, silicone. In some embodiments other flexible materials may be used to form elastomeric boot 630. Acoustic element 610 may then inserted into elastomeric boot 630 forming an acoustic seal and retaining the acoustic element in place. In various embodiments, a panel of acoustic mesh or cosmetic mesh 655 may be molded into continuous wall 635 as discussed in more detail above.

In some embodiments additional acoustic elements, such as acoustic microphone 615, may be mounted to plate 605. In various embodiment microphone 615 is secured to plate 605 with an adhesive. In some embodiments a plurality of elastomeric boots 630 may be over-molded on plate 605 and used to mount a plurality of acoustic elements. In various embodiments elastomeric boot 630 may be different than illustrated and may have other geometry.

Figure 7:
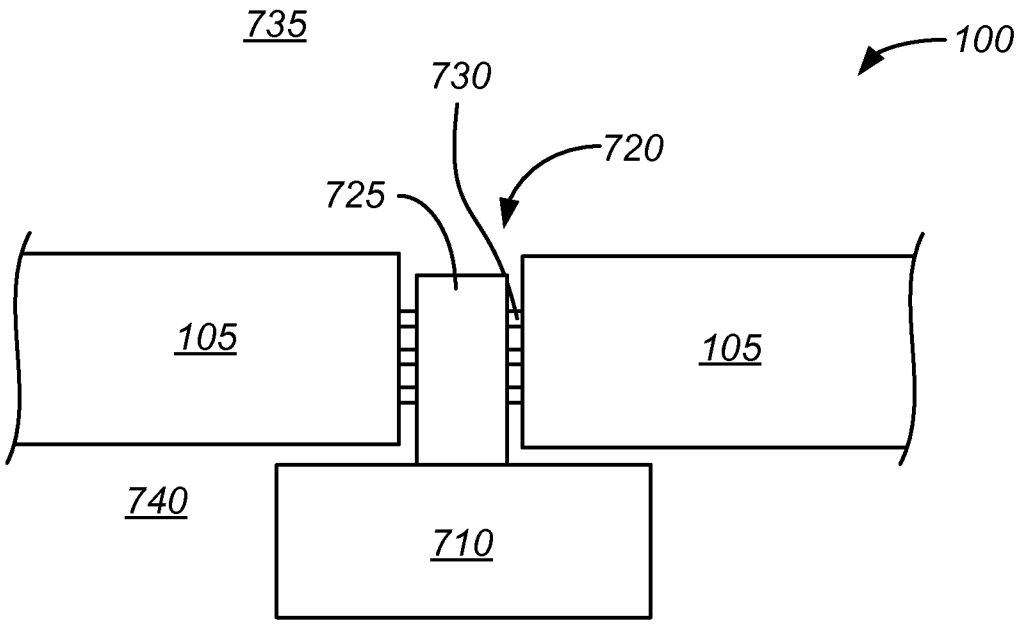
FIG. 7 is a partial cross-sectional view of the receiver aperture another embodiment of the electronic device illustrated in FIG. 1 where the receiver aperture contains an acoustic element having one or more flexible ribs.

Now referring to FIG. 7 an acoustic element 710 is illustrated that has a different configuration for attaching the acoustic element to and creating an acoustic seal with housing 105 of electronic device 100. In some embodiments housing 105 has an aperture 720 sized to receive a snout portion 725 of acoustic element 710. Snout portion 725 may have one or more ribs 730 molded on it that are sized to create an interference fit with aperture 720. One or more ribs 730 may be made from an elastomer or silicone material and configured to form an acoustic seal with housing 105 such that acoustic energy in external environment 735 is isolated from acoustic energy in internal environment 740. In some embodiments acoustic element 710 is a microphone.

Although electronic device 100 (see FIG. 1) is described and illustrated as one particular electronic device, embodiments of the invention are suitable for use with a multiplicity of electronic devices. For example, any device that receives or transmits audio, video or data signals may be used with the invention. In some instances, embodiments of the invention are particularly well suited for use with portable electronic media devices because of their potentially small form factor. As used herein, an electronic media device includes any device with at least one electronic component that may be used to present human-perceivable media. Such devices may include, for example, portable music players (e.g., MP3 devices and Apple's iPod devices), portable video players (e.g., portable DVD players), cellular telephones (e.g., smart telephones such as Apple's iPhone devices), video cameras, digital still cameras, projection systems (e.g., holographic projection systems), gaming systems, PDAs, as well as tablet (e.g., Apple's iPad devices), laptop or other mobile computers. Some of these devices may be configured to provide audio, video or other data or sensory output.

For simplicity, various internal components, such as the control circuitry, graphics circuitry, bus, memory, storage device and other components of electronic device 100 (see FIG. 1) are not shown in the figures.

In the foregoing specification, embodiments of the invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicants to be the scope of the invention, is the literal and equivalent scope of the set of claims that issue from this application, in the specific form in which such claims issue, including any subsequent correction. The specific details of particular embodiments may be combined in any suitable manner without departing from the spirit and scope of embodiments of the invention.

What is claimed is:

1. A receiver assembly comprising:

a plate including a penetration formed through the plate, wherein the plate is configured to be positioned against an interior surface of an electronic device housing such that the penetration is aligned with an aperture formed through the electronic device housing;

a continuous wall attached to the plate and defining a cavity aligned with the penetration, the continuous wall further defining a receiving opening that communicates with the cavity, wherein the receiving opening is positioned opposite the penetration and is sized to receive a speaker at least partially into the cavity; and a panel of acoustic mesh disposed within the cavity and having a portion integrally molded with the continuous wall.

2. The receiver assembly of claim 1 further comprising a speaker positioned within the cavity and configured to be in acoustic communication with the penetration.

3. The receiver assembly of claim 1 wherein the panel of acoustic mesh has a perimeter that is integrally formed with the continuous wall.

4. The receiver assembly of claim 1 wherein the panel of acoustic mesh is configured to span across the cavity.

5. The receiver assembly of claim 1 wherein the panel of acoustic mesh is insert molded into the continuous wall.

6. The receiver assembly of claim 1 wherein the continuous wall is made from an elastomeric material.

7. The receiver assembly of claim 1 wherein the continuous wall includes an interior surface having a plurality of sequential ridges that form an acoustic seal to the speaker.

8. The receiver assembly of claim 1 wherein a panel of cosmetic mesh is disposed between the panel of acoustic mesh and an exterior environment.

9. An electronic device comprising:

a housing having an aperture;

a plate mated to an inside surface of the housing and having a penetration that is aligned with the aperture;

a boot attached to the plate and including a cavity and a receiving opening formed by a continuous wall, wherein the cavity is aligned with the penetration and sized to receive a speaker through the receiving opening and at least partially into the cavity; and a panel of acoustic mesh disposed within the cavity and having a perimeter integrally formed with the continuous wall.

10. The electronic device of claim 9 further comprising a panel of cosmetic mesh disposed between the panel of acoustic mesh and an external environment.

11. The electronic device of claim 10 wherein the panel of cosmetic mesh is secured between the plate and the housing.

12. The electronic device of claim 10 wherein the panel of cosmetic mesh is integrally formed with the housing of the electronic device.

13. The electronic device of claim 10 wherein the panel of cosmetic mesh is formed from woven wires.

14. The electronic device of claim 9 wherein the panel of acoustic mesh is formed from a woven fabric.

15. The electronic device of claim 9 wherein the continuous wall includes an internal surface including a plurality of sequential ridges that are positioned to form an acoustic seal to the speaker that is received within the cavity.

16. The receiver assembly of claim 1 wherein the penetration is a first penetration and the plate includes a second penetration that is aligned with a microphone that is attached to the plate.

17. The electronic device of claim 9 wherein the penetration is a first penetration and the plate includes a second penetration that is aligned with a microphone that is attached to the plate.

18. The electronic device of claim 17 wherein the second penetration is aligned with the aperture.

* * * * *